United States Patent [19]

Yoshida et al.

[11] Patent Number: 4,679,611

[45] Date of Patent: Jul. 14, 1987

[54] COOLING APPARATUS FOR BELT TYPE CONTINUOUS CASTING MACHINE

[75] Inventors: Takashi Yoshida; Tomoaki Kimura; Tadashi Nishino, all of Hitachi; Sadayuki Saito, Chiba, all of Japan

[73] Assignees: Hitachi, Ltd.; Kawasaki Steel Corporation, both of Tokyo, Japan

[21] Appl. No.: 802,722

[22] Filed: Nov. 29, 1985

[30] Foreign Application Priority Data

Nov. 28, 1984 [JP] Japan ..... 59-251380

[51] Int. Cl.[4] ..... B22D 11/124

[52] U.S. Cl. ..... 164/431; 164/443

[58] Field of Search ..... 164/431, 432, 481, 443, 164/485, 348

[56] References Cited

FOREIGN PATENT DOCUMENTS 60-54247 3/1985 Japan ..... 164/431

*Primary Examiner*—Kuang Y. Lin

*Attorney, Agent, or Firm*—Antonelli, Terry & Wands

[57] ABSTRACT

A belt type continuous casting machine having a container for accommodating molten steel therein, a nozzle for supplying the molten steel from the container, a belt mold having a pair of metal belts and a pair of side members, and a cooling pad positioned adjacent to the back surface of the metal belt for forming a gap acting as a water film portion therebetween. The cooling pad is provided with a plurality of inlet ports and outlet ports for enabling a flow of cooling water into the water film portion therethrough. The diameters of these ports and the vertical distance between the inlet port and the adjacent outlet port are varied for controlling fluid pressure in the water film portion in correspondence with an external load acting on the metal belt. By securing a desired water film thickness deformation of the belt mold is prevented, and a flat cast slab with a good surface is obtained.

14 Claims, 17 Drawing Figures

COOLING APPARATUS FOR BELT TYPE CONTINUOUS CASTING MACHINE

BACKGROUND OF THE INVENTION

The present invention relates to a belt type continuous casting machine and, more particularly, to a cooling apparatus for a steel belt type continuous casting machine which enables an improving of a flatness of a slab.

In, for example, Japanese Laid Open Application No. 100851/82, a belt mold is proposed, formed by a pair of metal belts and a pair of side fixed board disposed between these belts, with the belt mold being cooled by a flow of cooling water in a gap or water film portion defined by the metal belt and a cooling pad having a plurality of inlet ports and outlet ports, and being disposed at a back portion of the metal belt.

In accordance with the above proposed construction, the cooling water is introduced from a plurality of inlet ports provided on the cooling pad and is discharged from outlet ports disposed around the inlet ports, the cooling pad includes elongated or oblong grooves around the inlet ports on the surface thereof and the gap or water film portion is formed between the metal belt and cooling pad. The gap or water film portion functions as a bearing by supporting the external load which is represented by the static pressure of the molten steel applied to the belt mold, whereby the steel belt and the cooling pad are maintained out of contact so as to minimize if not prevent wear of the belt caused by frictional sliding.

Since the above proposed cooling pad has been developed by placing importance on its function as a bearing, such proposed cooling pad is inadequate from a viewpoint of a cooling function for restricting a rise in temperature caused by heat from the molten steel inside of the belt mold.

Generally, the cooling strength through the belt is evaluated by a heat transfer rate $\alpha_w$, and a relationship between the flow velocity $V_w$, and a thickness of the water film in accordance with the following relationship:

$$\alpha_w = C_1 \frac{v_w^{0.8}}{\delta^{0.2}} \tag{1}$$

where:

$C_1$ is a constant.

If the formula (1) is represented by using the flow rate Q per unit of width for the belt wherein $Q = V_w \cdot \delta$, the following relationship may be obtained:

$$\alpha_w = C_1 \frac{v_w}{Q^{0.2}} = C_1 \frac{Q^{0.2}}{\delta} \tag{2}$$

As evident from the above relationships, the cooling strength $\alpha_w$ is directly proportional to the flow velocity $V_w$ and inversely proportional to the water film thickness $\delta$ if the supply flow rate is constant. The lower limit of the water film thickness $\delta$ is set at 0.5 mm taking into consideration a rise in temperature of the cooling water itself.

For this reason, in the above-proposed cooling pad construction, in the steady state of casting, a difference arises between the cooling strength in the water flow portion formed in the elongated or oblong groove portion and in the water flow portion formed between the belt and the cooling pad except for the elongated or oblong groove portion. The difference in cooling strength causes the belt to undulate and, if the belt mold is not flat, in the steel melting state at the initial stage of pouring the molten steel, the tightness between the metal belts and fixed side boards disposed between the metal belts is seriously impaired thereby leading to a leakage of the molten steel and also to casting accidents as well as deformation of the cast slabs. At the stage in which solidification progresses, an unflat belt mold disadvantageously promotes deterioration in quality because it is impossible to obtain a flat slab surface.

The aim underlying the present invention essential resides in providing a cooling belt apparatus for a belt type continuous casting machine wherein an arrangement is provided for enabling a maintaining of at least one of a cooling effect and supporting effect to an external load substantially equal over an entire surface of the belt mold.

In accordance with advantageous features of the present invention, the deformation of the belt mold is prevented in order to obtain a flat cast slab with a good surface finish.

According to the present invention, a belt type continuous casting machine is provided which includes a belt mold having a pair of movable belts and side members, a cooling pad is disposed adjacent to the movable belt for forming a water film portion therebetween and includes a plurality of ports for supplying or running cooling fluid into the water film portion. At least one of the diameters of the ports and a vertical distance between the ports is varied for equally controlling a fluid pressure in the water film portion.

By virtue of the features of the present invention, it is possible to prevent the belt mold from deformation, and to obtain a flat cast slab with a good surface finish.

DETAILED DESCRIPTION

Figure 1:
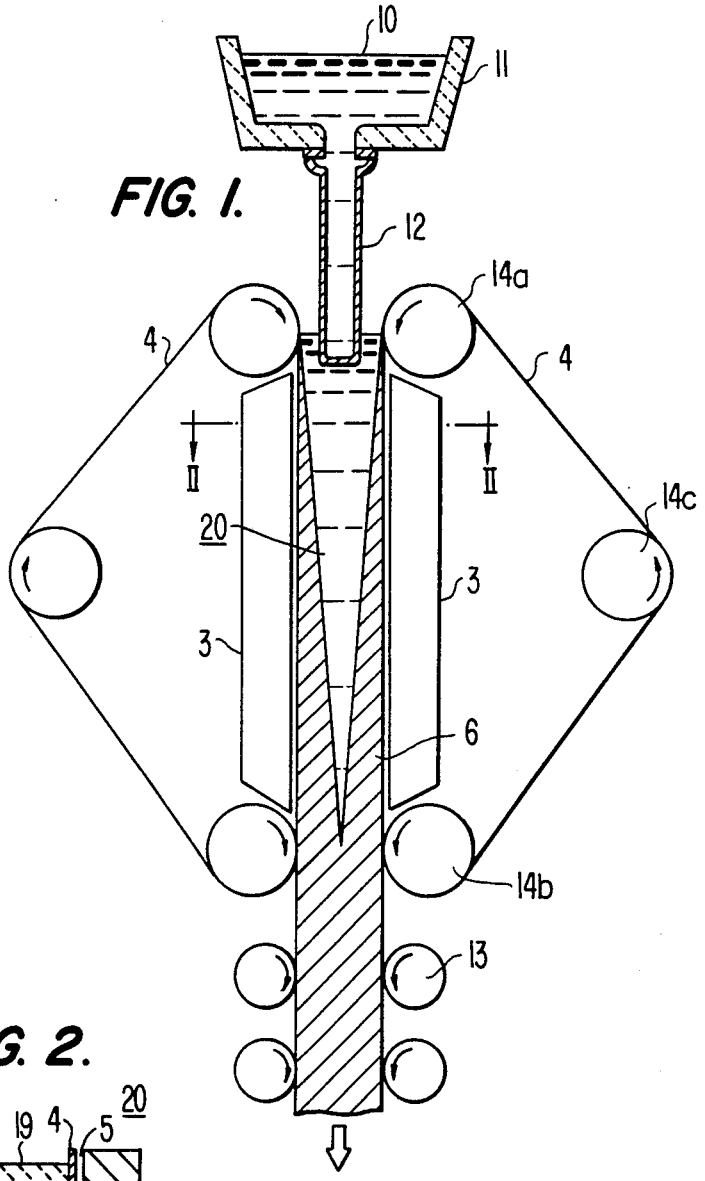
FIG. 1 is a schematic view of a belt type continuous casting machine having a cooling pad constructed in accordance with the present invention.
Figure 2:
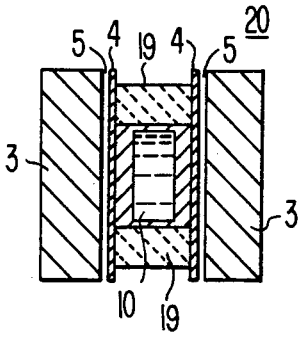
FIG. 2 is a cross-sectional view of a belt mold taken along the line II—II in FIG. 1.

Referring now to the drawings wherein like reference numerals are used throughout the various views to designate like parts and, more particularly, to FIGS. 1 and 2, according to these figures, a belt type continuous casting machine includes a container to tundish 11 accommodating molten steel therein, the container 11 includes a nozzle 12 at a bottom thereof. A belt mold 20 includes a pair of metal belts 4 and a pair of fixed side boards 19 disposed between the metal belts 4. The molten steel is supplied or poured from the container 11 through the nozzle 12 into the belt mold 20. A cooling pad 3, having a plurality of ports for enabling a running or supplying of a cooling medium, is provided on a back portion of each of the metal belts 4 and defines a gap portion 5 between the metal belt 4 and the cooling pads 3 as shown most clearly in FIG. 2. The belt mold 20 is cooled by running a cooling medium such as, for example, cooling water, in the gap portion 5. The molten steel 10 develops into a solidified shell 6 by cooling in the metal mold 20. A plurality of guide rolls 14*a*–14*c* drive the metal belt 4 synchronously with a drawing of the cast slab, and a plurality of driven pinch rolls 13 draw the cast slab from the metal belt mold 20.

Figure 3:
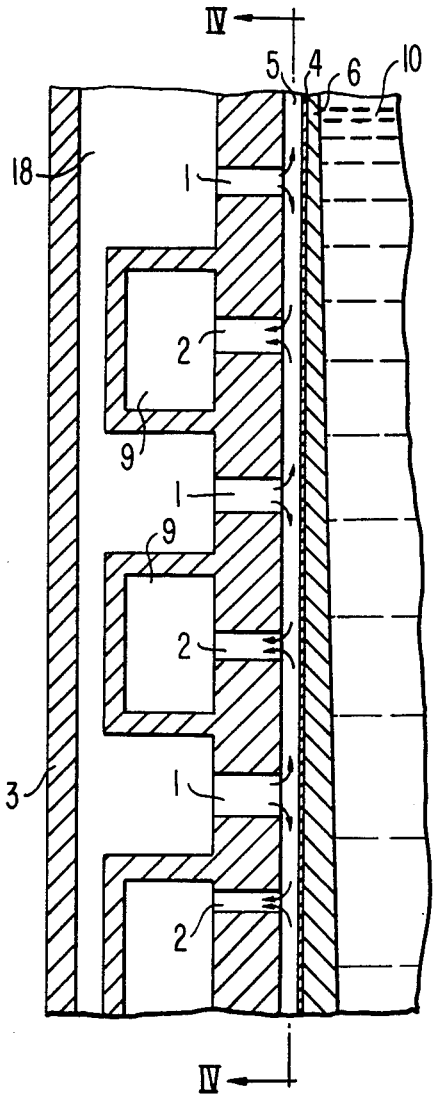
FIG. 3 is a cross-sectional detailed view, on an enlarged scale, of a portion of a cooling pad for the belt type continuous casting machine of the present invention.

As shown most clearly in FIG. 3, the cooling pad 3 is provided with a plurality of inlet ports 1 and outlet ports 2, with the belt mold 20 being cooled by the flow of cooling water in the gap or water film portion 5 defined between the metal belt 4 and the cooling pad 3. The cooling water is introduced from a plurality of the inlet ports provided in the cooling pad and is discharged from a plurality of the outlet ports 2 disposed around the inlet ports 1. A plurality of drain portions 9 are provided for discharging the cooling water flowing through the outlet ports 2 and a plurality of water supply portions 18 are provided for introducing the cooling water into the water film or gap portion 5 through the inlet ports 1.

Figure 5:
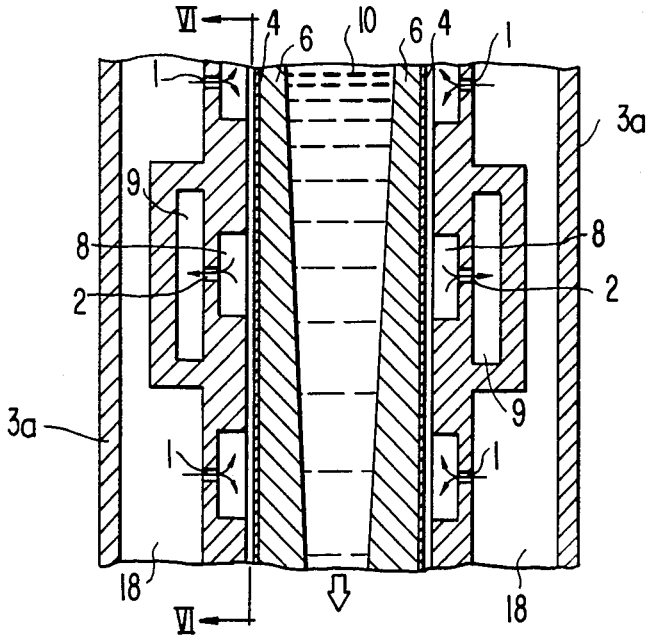
FIG. 5 is a cross-sectional detailed view, on an enlarged scale, of the belt mold of FIG. 1.
Figure 6:
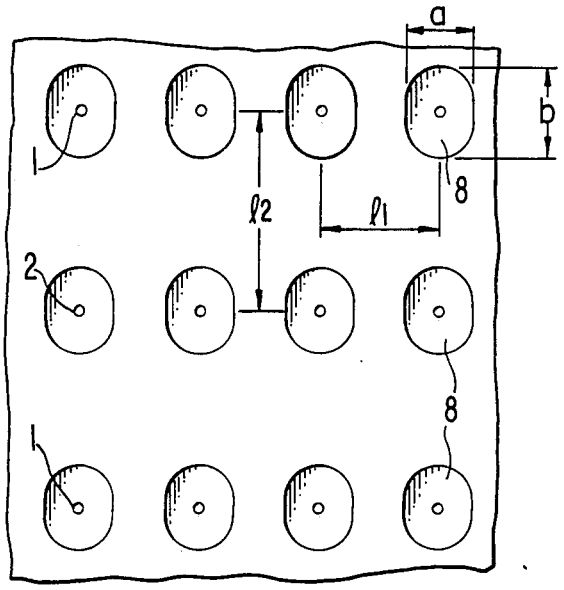
FIG. 6 is a view of the cooling pad taken along the line VI—VI in FIG. 5.

As shown most clearly in FIGS. 5 and 6, a cooling pad 3*a* may be provided which differs from the cooling pad 3 by virtue of the provision of an inlet port 1 and an outlet port 2 having an oblong (a×b) groove 8 disposed therearound. The cooling pad 3*a* forms a steady or stable gap or water film portion 5 between the respective metal belts 4 and the cooling pad 3*a*. The gap or water film portion 5 has a cooling function for restricting any rise of temperature caused by heat from the molten metal steel 10 within the belt mold 20. The water film or gap portion 5 functions as a bearing for supporting the external load which is represented by the static pressure of the molten steel 10 in the metal mold 20 to prevent contact between the metal belt 4 and the cooling pad 3 in order to prevent the wear and tear of the metal belt caused by friction or sliding.

The cooling apparatus for the belt type casting machine of the present invention has a number of significant features. First, in order to derive streams of running water having different pressures at the same flow rate from a common vessel of the same pressure in accordance with the distribution of supporting pressure in the running water with respect to the static pressure of the molten steel, which increases as it travels downward in the vertical direction, the inlet ports 1 are made smaller at the upper portion of the cooling pad 3 or 3*a* where a low pressure is required and are made larger at the lower portion of the cooling pad 3 or 3*a* where a high pressure is required, whereby the pressure of each portion of the cooling pad 3 or 3*a* is balanced by controlling the pressure on the basis of the difference in the pressure loss in the inlet ports 1, while in contrast the diameters of the outlet portions 2 are made larger at the upper portion and smaller at the lower portion so that the thickness of the water film can be secured. Secondly, taking into consideration the load distribution applied to the belt mold under a condition for conducting uniform cooling and producing a flat slab, namely, under the condition wherein the water film thickness and flow velocity are constant, the vertical distance between the inlet port and adjacent outlet ports 2 is greater at the upper portion and smaller at the lower portion of the cooling pad 3 or 3*a* whereby the difference in required pressure in the vertical direction is based on the difference in pressure loss caused by the difference in length of each flow path. These two advantageous or significant features of the present invention will be described in more detail hereinbelow.

The inadequate cooling ability found in the cooling pad 3 or 3*a* for the belt mold may be solved by considerably raising the flow rate. In other words, by providing a sufficient flow rate to adequately cool a portion where cooling strength is poor or by forming the surface of the cooling pad to be flat. However, an unsolved problem which still remains in that the distribution of pressure applied to the belt mold is such that there is a direct deflective deformation of the metal belt.

The amount of deflection $\delta_b$ of a metal belt is obtained by the following relationship:

$$\delta_b = \delta\left(P, l, \frac{1}{EI}\right), \tag{3}$$

where:

P represents a load applied to the belt, l represents a distance between the inlet port and the outlet port, E is a coefficient of vertical elasticity, and I is a secondary moment of a section.

A material with a high rigidity, namely with a high or great value of EI, which is used for the metal belt is advantageous with respect to deflection but disadvantageous in various points with regard to related equipment as a whole. In this connection, with regard to an actual casting machine, rigidity increases when the metal belt thickness is increased, but ultimately it is disadvantageously necessary to make the entire size of equipment larger taking into consideration the fatigue strength of the belt which is bent and straightened by guide rolls.

The load P and the distance l between the inlet port and the outlet port will now further be described. The external load P applied to the belt mold is a pressure represented by a static pressure p of a molten steel which increases as the belt mold travels downward in a vertical direction, and is qualitatively represented by the line a in FIG. 7. The load P is supported by the pressure of the running water between the inlet port 1 and outlet port 2 in the water film or gap portion 5 provided between the metal belt 4 and the cooling pad 3 or 3a. The supporting pressure $p_b$ is represented by the line b which forms a peak portion at the inlet port portion $b_1$ while a trough portion is formed at the outlet port portion $b_2$ in comparison with the line a' which is symmetrical with the line a. The pressure is balanced between the inlet port 1 and the outlet port 2 as a result of the following relationship:

$$\int (P_H + \Delta P)dx = \int \gamma_s H dx \quad (4)$$

where:

$P_H$ represents the trough portion of the line b, namely the average pressure of the outlet portions, $\Delta P$ represents the pressure drop between the inlet and the outlet, $\gamma_s$ represents the gravity of molten steel, and H represents a head of the molten steel.

Figure 7:
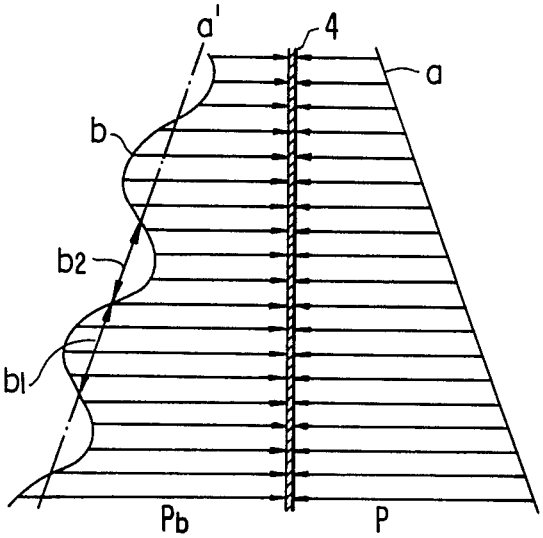
FIGS. 7 and 8 are diagramatic illustrations of a distribution of the load pressure applied to the belt mold.
Figure 8:
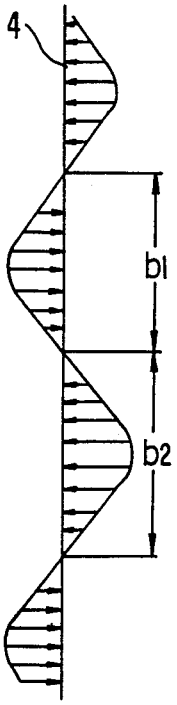
Figure 9:
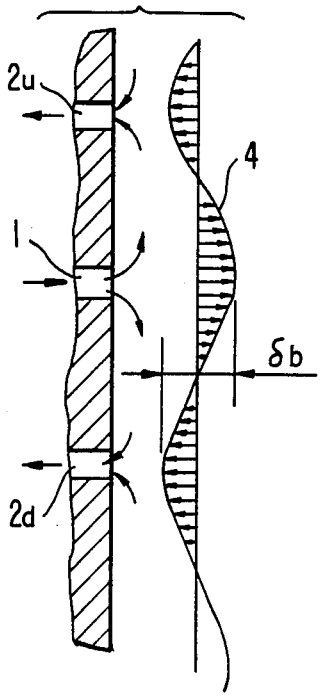
FIG. 9 is a diagramatic illustration of a deflection state of the belt mold.
Figure 10:
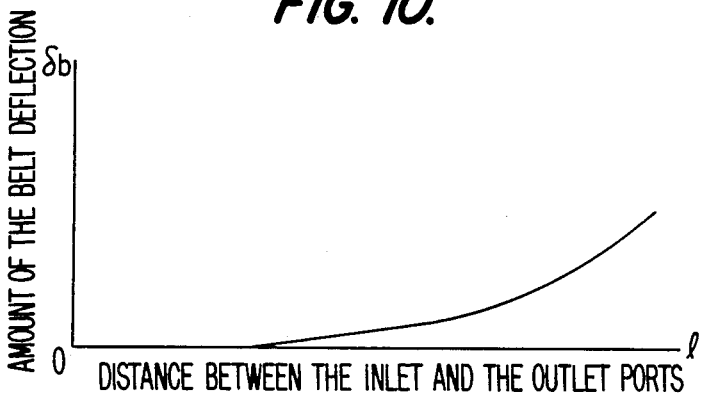
FIG. 10 is a graphical illustration of a relationship between the deflection of the metal belt and a distance between the inlet port.

Since it is impossible to equalize the supporting pressure $p_b$ with the external load pressure p along the vertical direction of the belt mold, the belt 4 receives the combined pressures $p_b$ and p represented in FIG. 7 as a load, as is shown in FIG. 8, and the dispersion of the distribution the load causes deflection. The distribution of the supporting pressure $p_b$ is determined by the influence of the running water on dynamic/static pressure and various pressure losses, and it is difficult to grasp accurately the form of the distribution. However, assuming that the flow between the inlet port 1 and the outlet port 2 is constantly running linearly from the inlet port 1 toward the outlet port 2, the metal belt 4 will be deflected as shown in FIG. 9. The approximate amount of deflection $\delta_b$ is qualitatively represented in FIG. 10, wherein the distance l between the inlet port 1 and outlet port 2 is represented by the abscissa, and the formula (3) is assumed only as a function of the distance l, with the other conditions being fixed. It is clear from FIG. 10 that a shorter distance l between the inlet port 1 and the outlet port 2 is advantageous from the viewpoint of deflection $\delta_b$ but increases the flow rate of the cooling water disadvantageously from the viewpoint of economy.

As a result of the above-described investigation, it has been determined that the present invention exhibits the following characteristics.

More particularly, in a belt type continuous casting machine composed of a movable belt 4 and a belt mold cooling apparatus 3 or 3a having a plurality of inlet ports 1 and outlet ports 2, the diameters of the inlet ports 1 and outlet ports 2 are varied in accordance with an external load, and the vertical distance between each inlet port 1 and the outlet port 2 adjacent thereto is also varied with respect to each of the corresponding distances between the other inlet ports 1 and adjacent outlet ports 2.

It is clear from experimentation that the pressure loss $\Delta P$ in the formula (4) is represented as in the following in the water running state which is necessary for cooling a belt mold.

$$\Delta P = \lambda \frac{Q^2 \gamma_w}{4 g \delta} \Delta x \quad (5)$$

where:

$\lambda$ is a pressure loss coefficient at the time of friction between a pipe and running water, and it is a constant which is determined by the flow rate Q, g represents gravity, and $\gamma w$ represents the specific gravity of water.

Figure 11:
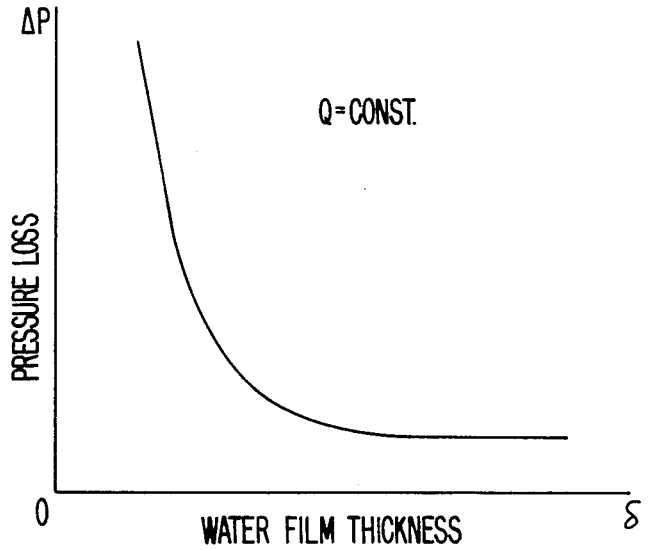
FIG. 11 is a graphical illustration of a relationship between pressure loss and a thickness of the water film.

FIG. 11 illustrates a relationship between $\Delta P$ and $\delta$ in the case of Q being given. In the optimum state for uniform cooling and detached support of the belt mold at a location of the water film or gap portion 5, namely, if the water film thickness $\delta$ and the flow velocity $V_w$ are constant, the following relationship exists:

$$\Delta P = K \cdot \Delta x \quad (6)$$

With g and $\gamma_w$ in formula (5) respectively representing gravity and the specific gravity of water, and if Q and $\delta$ are constant, it is represented by the constant K shown in formula (6).

Figure 12:
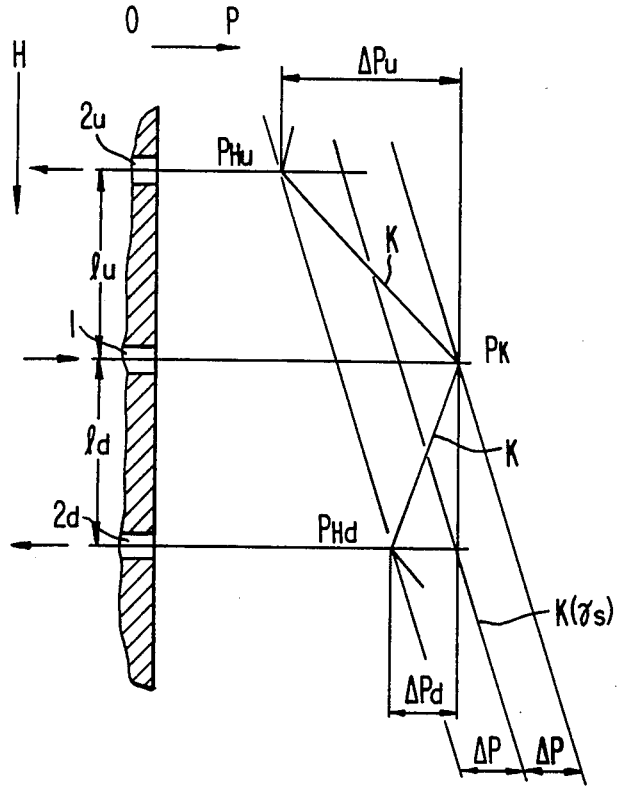
FIG. 12 is a schematic view of the distribution of the load pressure applied to the belt mold.

The composite graph of the distribution of the external load applied to the belt mold between the inlet and outlet ports 1, 2 and the support pressure distribution may be depicted at the line K in FIG. 12. From valid conditions for formula (2) and the continuity of the pressure applied in the vertical direction, the average supporting pressure $P_k$ at the inlet port 1 and that of $P_H$ at the outlet port 2 can be determined uniformly with respect to the static pressure of molten steel as a pressure necessary for the attached support. The pressures $P_K$, $P_H$ are determined on the basis of the pressure drop occurring when the water flows into the inlet port 1 or flows to the water film of gap portion 5.

That is, if the main pressure of water supply at the portion 18 in FIG. 5 is $P_0$, and the pressure at the drain portion 9 is 0, the following relationship exists:

$$P_K = P_0 - \Delta P x P_H = \Delta P_H \quad (7)$$

Figure 13:
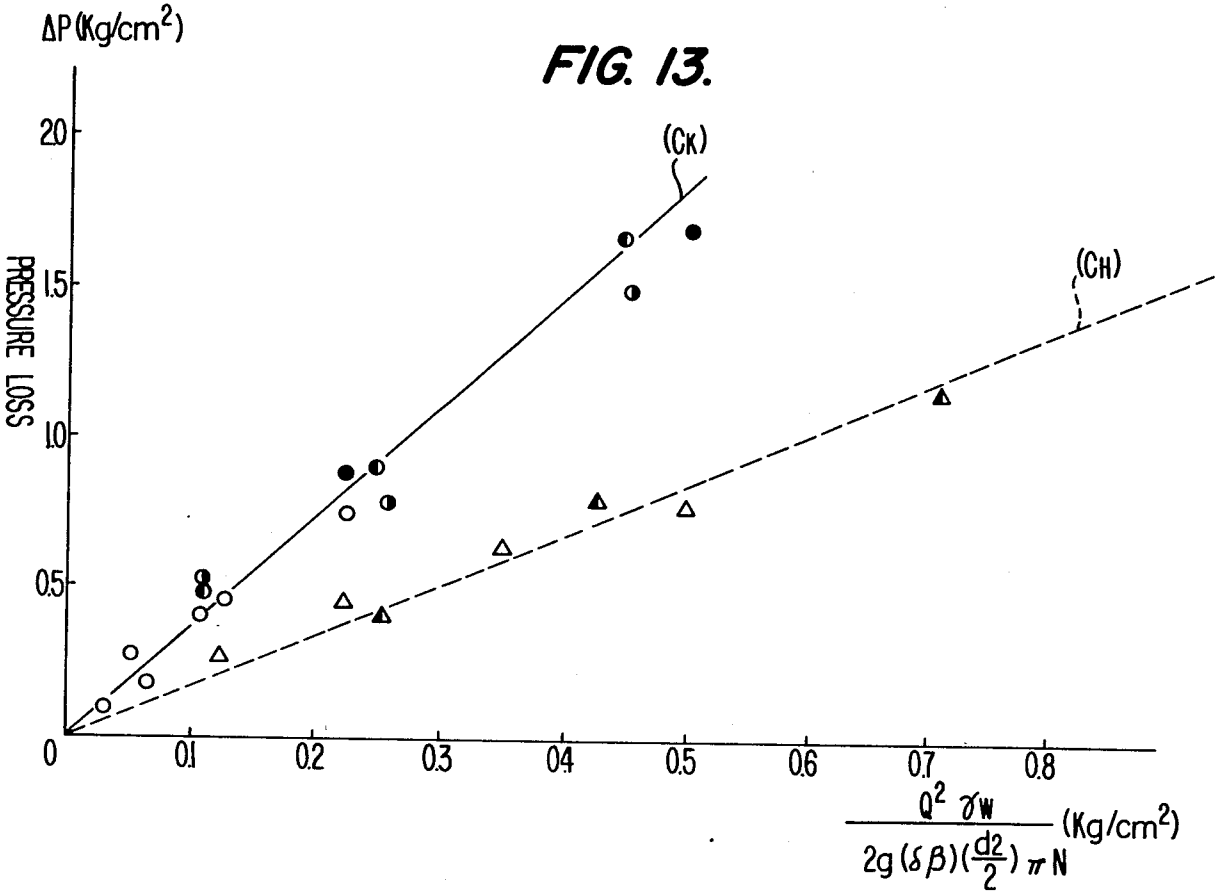
FIG. 13 is a graphical illustration of a relationship between the pressure loss of the inlet and outlet ports.

It was experimentally determined that the pressure losses $\Delta P_K$ and $\Delta P_H$ have the characteristics shown in FIG. 12 within a range of under 2 Kg/cm$^3$, respectively, and that it is represented by the following formula on the basis of the characteristics of the pressure loss shown in FIG. 13:

$$\Delta P_K (\Delta Ph) = C_K (C_H) \frac{Q^2}{2g(\delta B)(d_2)^2 \pi N} \gamma_w \quad (8)$$

where:

$C_K$ and $C_H$ respectively represent constants determined by configurations other than the diameters of the inlet and outlet ports, and which are indicated by gradients $C_K$ and $C_H$ in FIG. 13, d represents a diameter of the inlet or outlet ports, and N represents the number of ports in a widthwise direction of the cooling head.

When concrete values are provided for the flow rate Q and the number of inlet and outlet ports N, and the target or film thickness is represented by $\delta$, the pressure and diameter have the relationships shown in FIG. 13. In FIG. 13, the diameters of the respective ports with respect to the desired pressure are determined on the basis of these relationships.

An example of a variation of the diameter of the inlet and outlet ports 1, 2 will be shown in the following.

With the flow rate Q of the cooling water and the widthwise distance $l_B$ between the inlet and outlet ports 2, respectively represented by the following formulas $$Q = V_w \cdot \delta \cdot B \tag{8a}$$

$$l_B B/N \tag{8b}$$

Formula (8) is changed into the following formula (9) by substituting formulas (8a) and (8b) for Q and $l_B$:

$$\Delta P = C_K(C_H)\frac{Q^2}{2g\,(\delta B)\left(\frac{d}{2}\right)^2 \pi N}\gamma_w \tag{8}$$

$$= C_K(C_H)\frac{(V_w \cdot \delta \cdot B)^2}{2g\,(\delta B)\left(\frac{d}{2}\right)^2 \pi N}\gamma_w$$

$$= C_K(C_H)\frac{V_w^2 \cdot \delta \cdot B}{2g\left(\frac{d}{2}\right)^2 \pi N}\gamma_w$$

$$= C_K(C_H)\frac{V_w^2 \cdot \delta \cdot l_B \cdot \gamma}{2g\left(\frac{d}{2}\right)^2 \pi}\gamma_w \tag{9}$$

On the basis of this formula, the diameters of the ports 1, 2 are determined. When the diameters and the pressures of the upper and lower inlet ports are $\phi d_a$, $\phi d_d$, $P_{Ka}$ and $P_{Kd}$, respectively, the following relationship is obtained in a vertical type continuous casting machine:

$$\Delta P = P_{Ka} - P_{Kd} = \gamma \delta \cdot l_k$$

Figure 14:
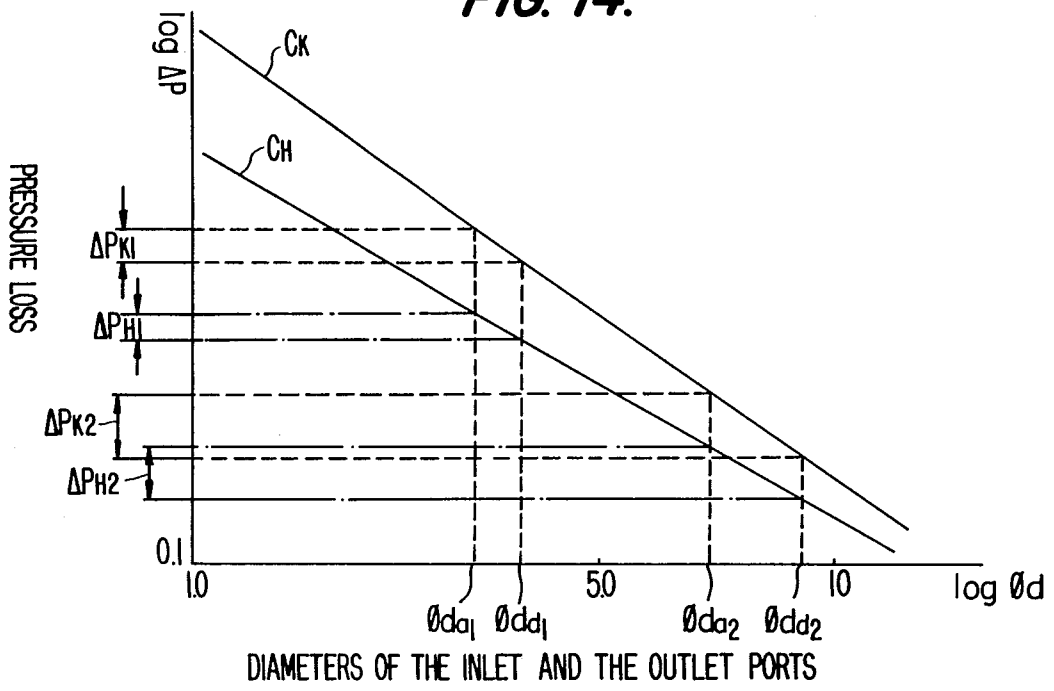
FIG. 14 is a graphical illustration of a relationship between a pressure loss and the diameters of the inlet and outlet ports.

In the case of selecting the diameters for the inlet and outlet ports 1, 2 when the target values of the widthwise distance $l_B = 20$ mm, the water film thickness $\delta = 0.5$ mm, and the flow velocity $V_w = 4.5$ m/sec, the relationship is clearly shown in FIG. 14. The difference of the diameters between $\phi d_{a1}$ and $\phi d_{d1}$ at the upper portion of the belt mold where the static pressure of molten steel is made small for the purpose of making the pressure loss $\Delta P$ large, while between $\phi d_{a2}$ and $\phi d_{d2}$ at the lower portion of the belt mold where $\Delta P$ is small is made large. For example, if the upper inlet is positioned at a distance H=200 mm from the surface of the molten steel and has a necessary diameter of $\phi d_{a1}$ obtained from the line $C_K$ in FIG. 14, the diameter of the lower inlet $\phi d_{d1}$ at the position of H=300 mm is approximately $\phi d_{a1} + 0.5$ mm, and if another inlet having a diameter $\phi d_{a2}$ is positioned at the distance H=1000 mm, the diameter of the lower inlet $\phi d_{d2}$ is approximately $\phi d_{a2} + 3$ mm.

On the other hand, selection of diameters of the outlet ports $\phi d_h$ is opposite to those of the inlet ports, namely, large at the upper portion and small at the lower portion in accordance with the line $C_H$ in FIG. 13 in order to make the $\Delta P$ at the upper portion small and the $\Delta P$ at the lower portion large.

The external load applied to the belt mold includes a uniform pressure by virtue of the belt tension which is applied to the mold portion having a curvature, and the diameters of the inlet and outlet ports are selected in correspondence with the external load including this uniform pressure. It is unnecessary to vary the diameters of these ports at a lower portion of the mold where the slab is adequately formed and the surface quality of the cast slab is not affected by the degree of pressure.

As to the variation of the position of the inlet and outlet ports 1, 2, as shown in FIG. 12, in order to maintain a constant flow rate Q of the cooling water which flows from the inlet port 1 to the outlets 2u and 2d in the vertical direction thereby maintaining a constant water film thickness, it is necessary to vary the upper and lower pressures $\Delta P_u$ and $\Delta P_d$ in the vertical direction, and from the above described formula (6) concerning the pressure loss, a difference is provided between $l_u$ and $l_d$ in $$\Delta P_u = K \cdot l_u,\ \delta P_d = K \cdot l_d.$$

If the ratio of $l_u$ and $l_d$ is represented by the formula $l_H = l_u + l_d$, and the following formula is applied, $$\beta_1 = \frac{l_u}{l_H},\ \beta_2 = \frac{l_d}{l_H}, \tag{10}$$

the following formula is obtained by representing the pressure gradient as K' and the pressure loss of the running water as K:

$$\beta_1 = \frac{K^2 + K'^2}{2K^2},\ \beta_2' = \frac{K^2 - K'^2}{2K^2} \tag{11}$$

Figure 15:
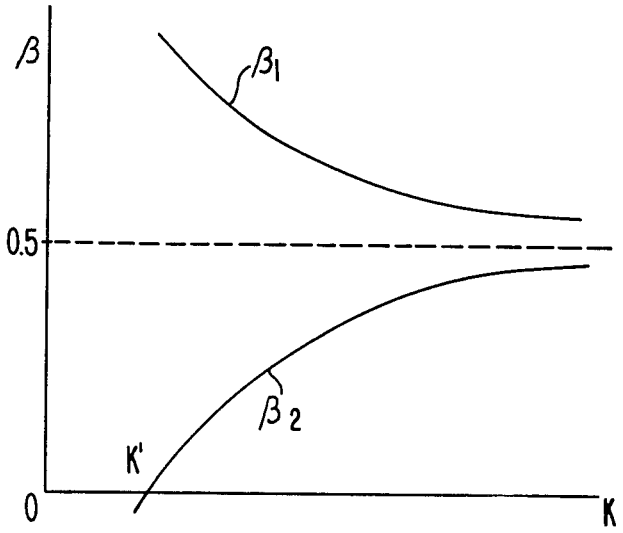
FIG. 15 is a graphical illustration of a relationship between the rate of length of a flow path.

FIG. 15 shows the relationship between $\beta_1$, $\beta_2$ and K and from this Figure and by solving the formula $l_u = \beta_1 \cdot l_H$, $l_d = \beta_2 \cdot l_H$ by providing concrete values for K, the values of $\beta_1$ and $\beta_2$ are obtained.

In the case of the vertical type, $K' = \gamma_s$, and if $\delta = 0.5$ mm, $V_w = 4.5$ m/s, $K = 37 \times 10^{-6}$ *Kg/mm2*, and $\beta_1$ and $\beta_2$ are about 0.55 and 0.45, respectively.

Accordingly, the upper pressure $\Delta P_u$ is higher than the lower pressure $\Delta P_d$. The difference in the length of flow paths between $l_u$ and $l_d$ is zero, namely $l_d = M_u$, as in the case of the diameter of the port, if the solidified shell has adequately developed.

Figure 4:
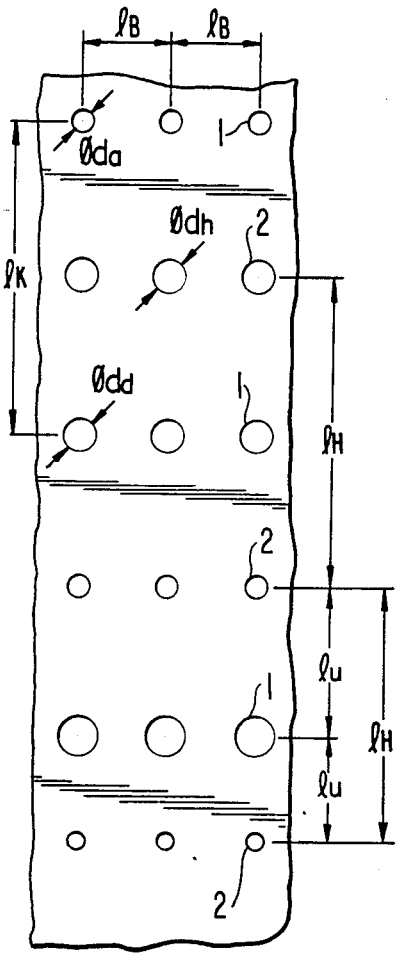
FIG. 4 is a front elevational view of the cooling pad taken along the line IV—IV in FIG. 3.

In this manner the present invention determines the dimensions of $\phi_{da}$, $\phi_{dd}$, $\phi_{dh}$, $l_u$, and $l_d$ of the cooling pad shown in FIG. 4 on the basis of the above described theory.

As described above, it is possible according to the invention to form a water film portion 5 on the metal belt 4 having a stable flow, whereby the deflection amount of the belt 4 caused by uneven cooling or deflection can be held down to a value not greater than 0.1 mm, thereby improving cast slab quality.

If the diameters of ports are inappropriate, the distribution of support pressure is controlled by varying the flow rate and thus uniform cooling is difficult.

Figure 16:
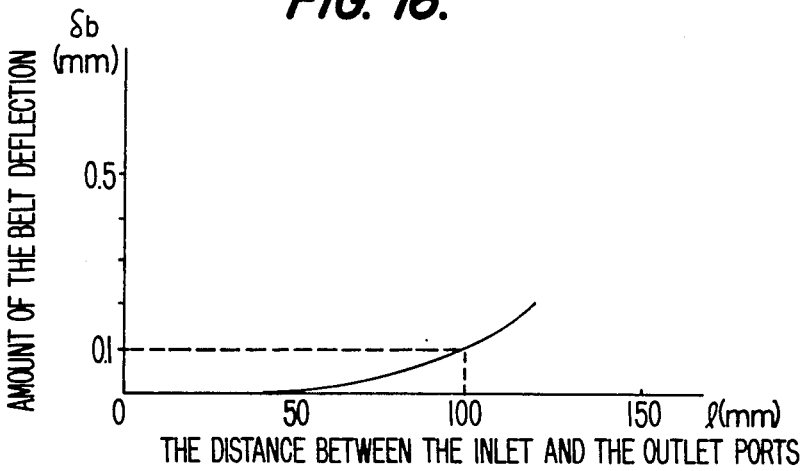
FIG. 16 is a graphical illustration of a relationship between the deflection of the metal belt and distance between the inlet and outlet ports.

Referring to FIG. 16, which shows the relationship between l and $\delta_b$ in FIG. 9 in which concrete values are provided, for example, thickness of the belt t=0.8 mm, flow velocity $V_w = 4.5$ m/sec, flow rate Q=const. and thickness of the water film $\delta = 0.5$ mm, if l is about 100 mm, the amount of deflection of the belt $\delta_b$ is able to keep less than 0.1 mm.

Figure 17:
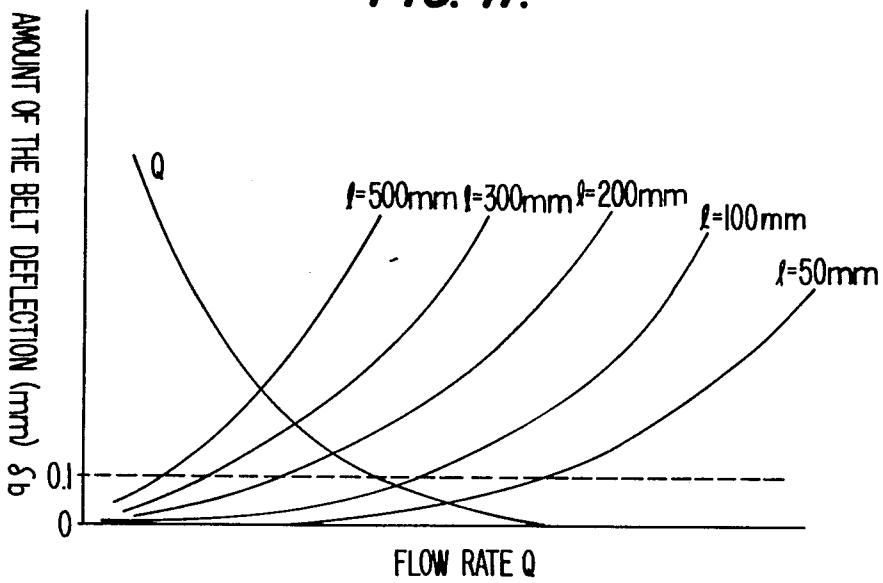
FIG. 17 is a graphical illustration of a relationship between the deflection of the metal belt and the flow rate.

FIG. 17 shows the relationship between, on the one hand, the amount of belt deflection $\delta_b$, and, on the other hand, the flow rate Q necessary for cooling and the length of the flow path l. The solid curve extending from the left upper portion to the right lower portion represents the minimum flow rate Q required for cooling, and the solid curves extending from the right lower portion to the left upper portion represent the amount of belt deflection $\delta_b$ with respect to each length l of the flow path.

If each distance between the inlet port 1 and the outlet port 2 is equal and the difference between the support pressure in the vertical direction is provided by discriminating the flow rate, the flow rate at the lower portion becomes small, as is clear from the formula (5), and the flow rate required for cooling is determined on the basis of the flow rate in the lower portion, so that the total flow rate disadvantageously increases.

As is apparent from the above detailed description, in the cooling pad for a belt type continuous casting machine according to the invention, the diameters of the inlet and outlet ports 1, 2 are varied in correspondence with an external load, or the vertical distance from each inlet port to the adjacent outlet port 2 is varied with respect to other inlet and outlet ports 1, 2. These improvements bring about various advantages. A desired water film thickness is secured between the belt mold and the cooling pad, whereby uniform and adequate cooling is enabled. Since deformation of the belt mold is prevented, an external load can be supported by running water with the necessary minimum flow rate while the belt mold is kept flat, and a flat cast slab with a good surface is thereby obtained.

As also evident from the above detailed description, the cooling apparatus for the belt type continuous casting machine ensures forming of equal water film thickness between the cooling pad and the movable metal belt in order to enable uniform cooling of the belt mold, and obtaining of flat cast slab with good surface.

While we have shown and described several embodiment in accordance with the present invention, it is understood that the same is not limited thereto but is susceptible to numerous changes and modifications as known to one having ordinary skill in the art, and we therefore do not wish to be limited to the details shown and described herein, but intend to cover all such modifications as are encompassed by the scope of the appended claims.

What is claimed is:

1. A cooling apparatus for a belt type continuous casting machine comprising:

a belt mold having a pair of movable belts and a pair of side members, a cooling pad disposed adjacent to the movable belt for forming a water film portion therebetween and having a plurality of inlet and outlet ports for running cooling water into the water film portion therethrough and wherein at least one of diameters of the inlet and outlet ports and a vertical distance between each inlet port and the outlet ports adjacent thereto is varied.

2. A cooling apparatus for a belt type continuous casting machine as claimed in claim 1, wherein the cooling pad is provided with a plurality of oblong grooves around the inlet ports and the outlet ports on the surface thereof.

3. A cooling apparatus for a belt type continuous casting machine as claimed in claim 1, wherein the distance between each inlet port and adjacent outlet port is a vertical distance.

4. A cooling apparatus for a belt type continuous casting machine as claimed in claim 1, wherein the diameters of the inlet ports located at a lower portion of the cooling pad is greater than the diameter of the inlet ports located at a high portion of the cooling pad.

5. A cooling apparatus for a belt type continuous casting machine as claimed in claim 1, wherein the diameter of the outlet ports located at a high portion of the cooling pad is greater than the diameter of the outlet ports located at a lower portion of the cooling pad.

6. A cooling apparatus for a belt type continuous casting machine as claimed in claim 1, wherrein the inlet ports and the outlet ports are aligned one after the other in a vertical direction.

7. A cooling apparatus for a belt type continuous casting machine as claimed in claim 2, wherein a distance between the inlet port and the adjacent outlet port disposed thereabove differ from a distance between the inlet port and the adjacent outlet port disposed therebelow.

8. A cooling apparatus for a belt type continuous casting machine as claimed in claim 7, wherein the distance between the inlet port and the adjacent outlet port disposed thereabove is greater than the distance between the inlet port and the adjacent outlet port disposed therebelow.

9. A cooling apparatus for a belt type continuous casting machine, the apparatus comprising:

means for accommodating molten steel therein, a nozzle means communicating with said accommodating means for enabling a discharge of the molten steel from said accommodating means, a belt mold having a pair of metal belts and a pair of side members for receiving the molten steel discharged from said nozzle means, and a cooling pad having a plurality of ports for enabling a flow of cooling water therethrough and disposed adjacent to the back surface of the respective metal belts for forming a water film portion therebetween, wherein at least one of the diameters of the ports and a vertical distance between the ports is varied.

10. A cooling apparatus for a belt type continuous casting machine as claimed in claim 9, wherein a plurality of the ports are fashioned as inlet ports for furnishing the cooling water into the water film portion and outlet ports for discharging the cooling water from the water film portion.

11. A cooling apparatus for a belt type continuous casting machine as claimed in claim 10, wherein the cooling pad is provided with a plurality of oblong grooves around the inlet ports and outlet ports on the surface thereof facing the water film portion.

12. A cooling apparatus for a belt type continuous casting machine as claimed in claim 10, wherein the diameters of the inlet ports located at a lower portion of the cooling pad is greater than the diameter of the inlet ports located at a higher portion of the cooling pad.

13. A cooling apparatus for a belt type continuous casting machine as claimed in claim 10, wherein the a diameter of the outlet ports located at a higher portion of the cooling pad is larger than a diameter of the outlet ports located at lower portions of the cooling pad.

14. A cooling apparatus for a belt type continuous casting machine as claimed in claim 10, wherein a distance between the inlet port and the adjacent outlet port disposed thereabove is longer than a distance between the inlet port and the adjacent outlet port disposed therebelow.

* * * * *